United States Patent [19]

Hübner et al.

[11] Patent Number: 4,461,020

[45] Date of Patent: Jul. 17, 1984

[54] METHOD OF PRODUCING AN ANODE AND ANODE THUS OBTAINED

[75] Inventors: Horst Hübner, Aachen, Fed. Rep. of Germany; Frederik Magendans; Bernhard J. P. Van Rheenen, both of Eindhoven, Netherlands

[73] Assignee: U.S. Philips Corporation, New York, N.Y.

[21] Appl. No.: 355,634

[22] Filed: Mar. 8, 1982

[30] Foreign Application Priority Data

Apr. 7, 1981 [NL] Netherlands ..... 8101697

[51] Int. Cl.[3] ..... H01J 35/08

[52] U.S. Cl. ..... 378/143; 378/144; 378/125

[58] Field of Search ..... 378/143, 144, 125

[56] References Cited

U.S. PATENT DOCUMENTS

| | | | |
|---|---|---|---|
| 3,836,807 | 9/1974 | Schreiner et al. | 378/144 |
| 3,936,689 | 2/1976 | Birjukova et al. | 378/144 |
| 4,298,816 | 11/1981 | Hirsch et al. | 378/144 |
| 4,331,902 | 5/1982 | Magendans et al. | 378/144 |
| 4,352,041 | 9/1982 | Hubner et al. | 378/144 |

*Primary Examiner*—Saxfield Chatmon

*Attorney, Agent, or Firm*—Paul R. Miller

[57] ABSTRACT

The invention relates to anodes for X-ray tubes and a method of producing same. Several layers are deposited one after another onto a substrate by means of chemical vapour deposition. The proposed combination of layers results in a proper bond to the substrate. The combination comprises a first layer of molybdenum or a molybdenum alloy; a second layer of a tungsten-molybdenum alloy and a third layer of tungsten or a tungsten alloy. The composition of the second layer varies over its thickness.

8 Claims, 2 Drawing Figures

METHOD OF PRODUCING AN ANODE AND ANODE THUS OBTAINED

Figure 1:
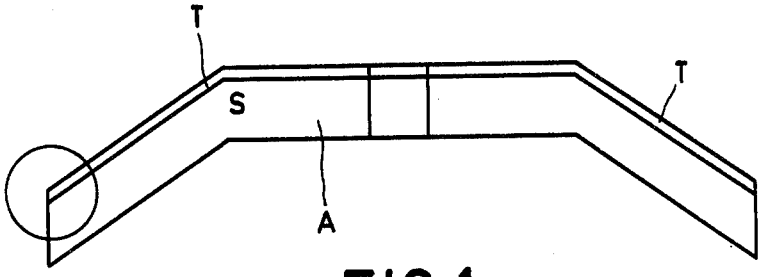

The invention relates to a method of producing an anode for X-ray tubes, wherein a target layer on the basis of tungsten is deposited by means of chemical vapour deposition (CVD) on a substrate of molybdenum or a molybdenum alloy. The invention also relates to an anode thus obtained.

Anodes are used in X-ray tubes, particularly as rotary anodes for X-ray tubes for medical examination.

French Patent Specification No. 2,153,765 discloses a method of producing an anode of the type described above. According to this prior art, a tungsten target layer for the electrons is provided on a molybdenum substrate. The tungsten layer is deposited by means of chemical vapour deposition (CVD). A barrier layer is provided between the target layer and the substrate, also by means of CVD.

The invention has for its object to improve the prior art method, whereby an improved bond is obtained between the target layer and the substrate.

The method according to the invention is characterized in that the following layers are applied, one after the other, on the substrate by CVD.

a. a layer (1) of molybdenum or a molybdenum alloy containing more than 95% by weight of molybdenum.

b. a layer (2) of a tungsten-molybdenum alloy the composition of which varies in thickness direction so that the molybdenum content at the side contiguous to layer (1) is 95–100% by weight and at the other side 0–5% by weight whereas the tungsten content varies from 0–5% by weight to 95–100% by weight.

c. a layer (3) consisting of tungsten or a tungsten alloy, whereafter the substrate with the layers deposited thereon is annealed in a non-oxidizing atmosphere for from 10 minutes to 6 hours at 1200°–1700° C. The use of layer (1) and layer (2) results in a gradual transition in the coefficient of expansion between the substrate and the layer (3). This results in an improved bond between the substrate and the layer (3). A further improvement of the bond is obtained by forming the layer (3) from two layers: an exterior layer (**3*b*) and an intermediate layer (3*a*) between layer 2 and the exterior layer (3*b*). A suitable choice of the material of which layers 3*a* and 3*b*** are made results in a more gradual variation of the coefficient of expansion.

Consideration has already been given to the provision between the substrate and the target layer of an intermediate layer having a gradually changing composition. German Patent Application No. 2,400,717 describes a method wherein by fusing a tungsten-rhenium alloy on a molybdenum substrate an intermediate layer having a molybdenum concentration which varies in the thickness direction would be obtained. The proposed method is, however, difficult to implement, at any rate it is not easily reproduceable. For mass production the method used must be reproduceable.

The method in accordance with the invention can be performed in a reproduceable manner in a very simple way. A suitable method of depositing the above-mentioned layer (2) is, for example, described in Electrodeposition and Surface Treatment, 2 (1973/74) pages 435–446, "Vapour deposition of Molybdenum-Tungsten" by J. G. Donaldson et al.

Figure 2:
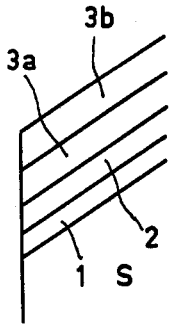

The invention will now be further described by way of example with reference to the accompanying drawing in which FIG. 1 is a cross-sectional view through an anode in accordance with a preferred embodiment of the invention and FIG. 2 shows a detail of the encircled portion in FIG. 1.

FIG. 1 shows an anode A formed by a substrate S and a target layer T deposited thereupon. The substrate S consists of molybdenum or a molybdenum alloy such as, for example, TZM (a molybdenum alloy containing 0.5% by weight of Ti; 0.07% by weight of Zr and 0.03% by weight of C). The target layer T may alternatively cover a smaller or a larger portion of the substrate S. The target T may alternatively be provided on a recessed portion in the substrate S.

As shown in FIG. 2, the target layer T comprises the layers 1, 2, **3*a* and 3*b*. Layer 1 consists of molybdenum or a molybdenum alloy with more than 95% by weight of molybdenum. Layer 2 consists of a tungsten-molybdenum alloy which has a gradually varying composition. At the side contiguous to layer 1, layer 2 contains 95–100% by weight of molybdenum and 0–5% by weight of tungsten; at the side contiguous to layer 3*a* it contains 95–100% by weight of tungsten and 0–5% by weight of molybdenum. Layer 3*a* consists of a layer containing 95–100% of tungsten, while layer 3*b* consists of tungsten or a tungsten alloy. The composition of layer 3*b*** corresponds to the composition of the prior art target layers for X-ray anodes, such as, for example, tungsten, tungsten alloys having one or more of the elements rhenium, tantalum, osmium, iridium, platinum and similar elements.

The layers 1, 2, **3*a* and 3*b*** are all deposited by means of CVD processes which are known per se. After deposition of the layers, an annealing operation is performed for 10 minutes to 6 hours at 1200°–1600° C. During said annealing operation some diffusion between the different layers occurs, which also results in an improved bond. In some cases it may be possible to perform the annealing operation after only a part of the layers has been deposited.

Preferably, the layers 1, 2, **3*a* and 3*b* are deposited with the following thicknesses: layer 1 has a thickness of 1–200 microns preferably 10–50 μm, layer 2 has a thickness of 1–300 microns, preferably 50–100 μm, layer 3*a* has a thickness of 10–500 μm, preferably 200–300 μm and layer layer 3*b*** has a thickness of 50–1000 microns, preferably 200–300 μm.

The invention will now be further described with reference to the following example.

EXAMPLE

A layer of molybdenum is first deposited with a thickness of 20 μm (layer 1) by means of CVD on a suitable substrate made of TZM (a molybdenum alloy containing 0.5% by weight of Ti, 0.07% by weight of Zr, 0.03% by weight of C). The substrate is preheated at 1000° C. The molybdenum is supplied as $MoF_6$. The $MoF_6$ and also the fluorides to be specified below are reduced by $H_2$. The conditions during the process are as follows: gas pressure 15 mbar, temperature 1000° C., flow rate of the $H_2$0.5 l per minute, flow rate of the $MoF_6$0.04 l per minute. The liters of gas have been converted for all cases into atmospheric pressure and room temperature. As soon as the desired layer thickness has been obtained, the flow rate of $MoF_6$ is gradually reduced to zero and a gradually increasing quantity of $WF_6$ is supplied (increasing from 0 to 0.05 l per minute), all this in such a way that a layer (2) is obtained having a thickness of 50 μm, in which the molybdenum concentration decreases from 100 to 0% and the tungsten concentration increases from 0 to 100%. The feed forward of $WF_6$ is continued until a layer (3*a*) of pure tungsten has been obtained having a thickness of 250 μm. Then the feed of the WF6 is slightly reduced and $ReF_6$ is simultaneously supplied so that a layer (3*b*) containing 4% of Re is deposited. This is continued until layer (3*b*) has a thickness of 250 μm.

The substrate with the layers 1, 2, 3*a* and 3*b* deposited thereupon is finally heated for 3 hours at 1600° C. in a non-oxidizing atmosphere. During this annealing operation some diffusion occurs between the substrate and the layers and between the respective layers. Such diffusion ensures a proper bond between the different layers and the substrate.

What is claimed is:

1. An anode for X-ray tubes comprising a substrate of molybdenum or molybdenum alloy, a first layer on said substrate of molybdenum or molybdenum alloy having more than 95% by weight of molybdenum, a second layer on said first layer of a tungsten-molybdenum alloy, said second layer having a composition at a side contiguous to said first layer of 95–100% by weight of molybdenum content and 0–5% by weight of tungsten content, said composition varying across said second layer to a composition at the opposite side from said first layer of 0–5% by weight of molybdenum content and 95–100% by weight of tungsten content, and a third layer on said second layer of tungsten or tungsten alloy.

2. An anode according to claim 1, wherein said first layer has a thickness of 1–200 μm, said second layer has a thickness of 50–100 μm, and said third layer has a thickness of 400–600 μm.

3. An anode according to claim 2, wherein said third layer consists of a first sublayer of tungsten on said second layer and a second sublayer of tungsten or a tungsten alloy.

4. An anode according to claim 1, wherein said third layer consists of a first sublayer of tungsten on said second layer and a second sublayer of tungsten or a tungsten alloy.

5. A method of producing anodes for X-ray tubes comprising the steps of chemically vapor depositing a first layer of molybdenum or molybdenum alloy containing more than 95% by weight of molybdenum onto a substrate of molybdenum, chemically vapor depositing a second layer of a tungsten-molybdenum alloy onto said first layer, said second layer having a composition at a side contiguous to said first layer of 95–100% by weight of molybdenum content and 0–5% by weight of tungsten content, said composition varying across said second layer to a composition at the opposite side from said first layer of 0–5% by weight of molybdenum content and 95–100% by weight of tungsten content, chemically vapor depositing a third layer of tungsten or tungsten alloy onto said opposite side of said second layer, and annealing said substrate and said layers in a non-oxidizing atmosphere for 10 minutes to 6 hours at 1200°–1700° C.

6. A method according to claim 5, wherein said first layer is deposited with a thickness of 1–200 μm, said second layer is deposited with a thickness of 50–100 μm, said said third layer is deposited with a thickness of 400–600 μm.

7. A method according to claim 6, wherein said third layer is formed of a first sublayer consisting of tungsten on said second layer and a second sublayer consisting of tungsten or a tungsten alloy.

8. A method according to claim 5, wherein said third layer is formed of a first sublayer consisting of tungsten on said second layer and a second sublayer consisting of tungsten or a tungsten alloy.

* * * * *